US010668476B2

(12) United States Patent
Colson et al.

(10) Patent No.: US 10,668,476 B2
(45) Date of Patent: Jun. 2, 2020

(54) ENCLOSURES FOR VERTICAL PULVERIZER SYSTEMS

(71) Applicant: General Electric Technology GmbH, Baden (CH)

(72) Inventors: Paul M. Colson, Westfield, MA (US); Rory G. Eastman, East Granby, CT (US); Robert S. Prairie, Vernon, CT (US); Gregory R. Strich, Enfield, CT (US)

(73) Assignee: General Electric Technology GmbH, Baden (CH)

( * ) Notice: Subject to any disclaimer, the term of this patent is extended or adjusted under 35 U.S.C. 154(b) by 439 days.

(21) Appl. No.: 15/226,943

(22) Filed: Aug. 3, 2016

(65) Prior Publication Data

US 2018/0036739 A1 Feb. 8, 2018

(51) Int. Cl.
*B02C 15/04* (2006.01)
*B02C 15/00* (2006.01)
(Continued)

(52) U.S. Cl.
CPC ..... *B02C 15/04* (2013.01); *B02C 15/00* (2013.01); *B02C 15/007* (2013.01); *B02C 23/26* (2013.01); *B02C 23/30* (2013.01)

(58) Field of Classification Search
CPC ..... B65D 25/005; B65D 1/40; B65D 11/08; B65D 11/20; B02C 15/04; B02C 15/045;
(Continued)

(56) References Cited

U.S. PATENT DOCUMENTS 1,838,998 A * 12/1931 Loesche ..... B02C 15/04 241/220
2,079,155 A * 5/1937 Crites ..... B02C 15/04 241/53

(Continued)

FOREIGN PATENT DOCUMENTS

EP 0 232 321 B1 6/1990

OTHER PUBLICATIONS

International Search Report and Written Opinion issued in connection with corresponding PCT Application No. PCT/EP2017/068544 dated Oct. 30, 2017.

(Continued)

*Primary Examiner* — Shelley M Self
*Assistant Examiner* — Katie L. Parr
(74) *Attorney, Agent, or Firm* — James Pemrick; Hoffman Warnick LLC

(57) ABSTRACT

Enclosures for vertical pulverizer systems are disclosed. The enclosure may include a vertically oriented cylindrical body forming an internal cavity. The enclosure may also include a cover positioned above the cylindrical body. The cover may have a curved surface. Additionally, the enclosure may include an inlet channel formed through the cover, where the inlet channel may be in fluid communication with the internal cavity of the cylindrical body, and an outlet channel formed through the cover, adjacent the inlet channel. Furthermore, the enclosure may include a base component positioned within the internal cavity of the cylindrical body, opposite the cover, the base component having a curved surface, a journal opening formed through the cylindrical body between the cover and the base component, and a journal opening cover coupled to the cylindrical body. The journal opening cover may cover the journal opening.

17 Claims, 8 Drawing Sheets

(51) Int. Cl.
*B02C 23/26* (2006.01)
*B02C 23/30* (2006.01)

(58) Field of Classification Search
CPC ..... B02C 15/06; B02C 15/007; B02C 23/24; B02C 23/26; B02C 23/30; B02C 2015/002; B02C 15/001; B02C 15/006
USPC ..... 241/285.1, 49, 50, 62, 69, 47, 52, 166, 241/167; 220/601, 661, 669
See application file for complete search history.

(56) References Cited

U.S. PATENT DOCUMENTS 2,848,170 A * 8/1958 Crites ..... B02C 15/04 241/117
4,372,496 A * 2/1983 Maliszewski ..... B02C 25/00 241/109
4,538,768 A * 9/1985 Paskowski, Jr. ..... B02C 15/004 241/101.2
4,717,082 A 1/1988 Guido et al.
5,137,218 A * 8/1992 Sutherland ..... B02C 23/04 241/31
5,386,619 A * 2/1995 Wark ..... B02C 15/007 241/109
5,957,300 A * 9/1999 Nardi ..... B02C 15/001 209/139.2
7,770,829 B2 * 8/2010 Wark ..... B02C 15/004 241/119
8,308,093 B2 11/2012 Wark
8,425,116 B2 8/2013 King et al.
9,021,967 B2 5/2015 Blunier et al.
2009/0008487 A1 1/2009 Smith et al.
2013/0056569 A1 * 3/2013 Yamaguchi ..... B02C 15/004 241/206
2014/0076210 A1 * 3/2014 Daimaru ..... F23K 3/02 110/222
2015/0053799 A1 * 2/2015 Storm ..... B02C 15/001 241/31
2016/0096182 A1 4/2016 Storm
2018/0036739 A1 2/2018 Colson et al.
2018/0169661 A1 * 6/2018 Fortsch ..... B02C 15/001
2018/0236456 A1 * 8/2018 Daubert ..... B02C 15/04

OTHER PUBLICATIONS

EP Search Report and Written Opinion for corresponding EP Application No. 17742439.7 dated May 2, 2020, 6 pages.

* cited by examiner

ENCLOSURES FOR VERTICAL PULVERIZER SYSTEMS

TECHNICAL FIELD

The disclosure relates generally to pulverizer systems, and more particularly to enclosures for vertical pulverizer systems.

BACKGROUND

Vertical pulverizer systems are used to process raw material to be used by a variety of power generation systems. For example, conventional vertical pulverizer systems may grind coal into a fine particle. The fine coal particles created by the vertical pulverizer system may be utilized by a boiler of a steam turbine system configured to generate power. Conventional vertical pulverizers typically include grinding mechanisms positioned within a sealed chamber that may grind or crush the raw material to form the fine particles.

During the pulverizering process performed by the vertical pulverizer system, the chamber, and the components positioned within the chamber, may experience a variety of stresses. For example, pressure loads may build or grow within the chamber due to the grinding mechanism having to apply enough pressure to grind the raw material. Additionally, in some instances, the raw material may be combustible (e.g., coal). As a result, the chamber of the vertical pulverizer system may also experience explosive loads as the chamber heats up, becomes an ignition source, and the potentially combustible raw material is ground. Furthermore, the chamber may experience thermal loads and/or large swings in temperature during the grinding process. Additionally, large mechanical loads may be experienced by the chamber and/or the components within the chamber because of the mechanical loads required to grind the raw material within the vertical pulverizer system.

To compensate for these relatively high loads (e.g., thermal, mechanical, pressure, explosive) the conventional chambers are often made up of a variety of distinct components formed from very thick metal or metal alloys. These conventional chambers are typically large in size, include a variety of connection joints (e.g., welds between components) and angular transitions between surfaces and/or components forming the chamber. Because of the size, thickness and/or the number of components required to manufacture conventional chambers for a vertical pulverizer system, the chambers are often expensive, time consuming to build and difficult to provide maintenance on due to the number of portions or components forming the chamber.

Additionally, although most conventional chambers are built to withstand the experienced stresses or loads, conventional chambers include high stress concentration areas that experience the loads more than other portions of the chamber. For example, angled transitions between portions and/or components of the conventional chambers experience greater or more concentrated stress and/or loads during operation of the vertical pulverizer system.

SUMMARY

One embodiment may include an enclosure for a vertical pulverizer system. The enclosure may include a cylindrical body forming an internal cavity. The cylindrical body may be vertically oriented. The enclosure may also include a cover positioned above the cylindrical body. The cover may have a curved surface. Additionally, the enclosure may include an inlet channel formed through the cover, where the inlet channel may be in fluid communication with the internal cavity of the cylindrical body, and an outlet channel formed through the cover, and adjacent to the inlet channel. Furthermore, the enclosure may include a base component positioned within the internal cavity of the cylindrical body, opposite the cover, the base component having a curved surface, a journal opening formed through the cylindrical body between the cover and the base component, and a journal opening cover coupled to the cylindrical body. The journal opening cover may cover the journal opening.

Another embodiment may include an enclosure for a vertical pulverizer system. The enclosure may include a cylindrical body forming an internal cavity, where the cylindrical body may be vertically oriented. The enclosure may also include a cover coupled to the cylindrical body. The cover may include a concave surface, a material inlet channel formed through the cover, and a particle outlet channel formed through the cover, and adjacent to the material inlet channel. Additionally, the enclosure may include a base component positioned within the internal cavity of the cylindrical body, opposite the cover. The base component may have a concave surface. Furthermore, the enclosure may include a curved journal opening formed through the cylindrical body between the cover and the base component, and a journal opening cover coupled to the cylindrical body and covering the curved journal opening. The journal opening cover may include a door configured to provide access to the internal cavity of the cylindrical body, a trunnion support positioned adjacent and below the door, where the trunnion support angularly extending away from the cylindrical body, and a curved side wall positioned substantially perpendicular to the door. The curved side wall may be coupled directly to the cylindrical body and the trunnion support.

A further embodiment may include a vertical pulverizer system. The vertical pulverizer system may include a support including a seat, a gearbox positioned within the seat of the support, and an enclosure positioned above the support and the gearbox. The enclosure may include a cylindrical body coupled to the support. The cylindrical body may form an internal cavity. The enclosure may also include a cover positioned above the cylindrical body. The cover may include a concave surface, a material inlet channel formed through the cover, and a particle outlet channel formed through the cover, and adjacent to the material inlet channel. Additionally, the enclosure may also include a base component positioned within the internal cavity of the cylindrical body, opposite the cover. The base component may include a concave surface, and an aperture formed through the base component. Furthermore, the enclosure may include a curved journal opening formed through the cylindrical body between the cover and the base component, and a journal opening cover coupled to the cylindrical body and covering the curved journal opening. The vertical pulverizer system may also include a rotatable table positioned within the internal cavity formed by the cylindrical body. The rotatable table may be coupled to the gearbox and may extend through the aperture of the base component. Additionally, the vertical pulverizer system may include a journal positioned above and adjacent the rotatable table, and a trunnion coupled to the journal and positioned adjacent the journal opening cover of the enclosure. Furthermore, the vertical pulverizer system may include a particle screening device positioned adjacent the cover, where at least a portion of the particle screening device is positioned within the internal cavity formed by the cylindrical body of the enclosure.

BRIEF DESCRIPTION OF THE DRAWINGS

The disclosure will be readily understood by the following detailed description in conjunction with the accompanying drawings, wherein like reference numerals designate like structural elements, and in which.

Figure 1:
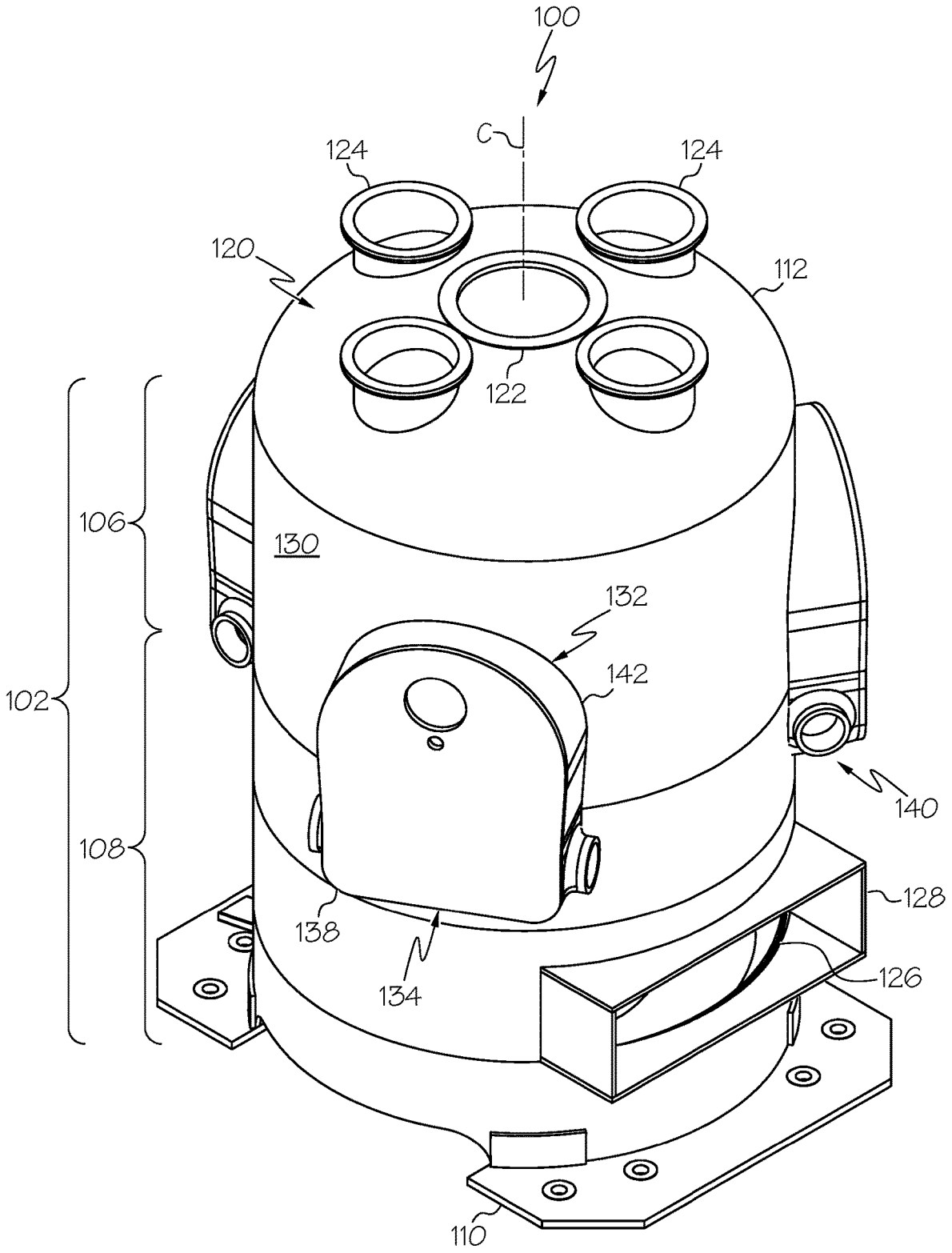
FIG. 1 depicts an illustrative isometric view of an enclosure for a vertical pulverizer system, according to embodiments of the invention.

It is noted that the drawings of the invention are not necessarily to scale. The drawings are intended to depict only typical aspects of the invention, and therefore should not be considered as limiting the scope of the invention. In the drawings, like numbering represents like elements between the drawings.

DETAILED DESCRIPTION

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

The following disclosure relates generally to pulverizer systems, and more particularly to enclosures for vertical pulverizer systems.

These and other embodiments are discussed below with reference to FIGS. 1-7. However, those skilled in the art will readily appreciate that the detailed description given herein with respect to these Figures is for explanatory purposes only and should not be construed as limiting.

Figure 2:
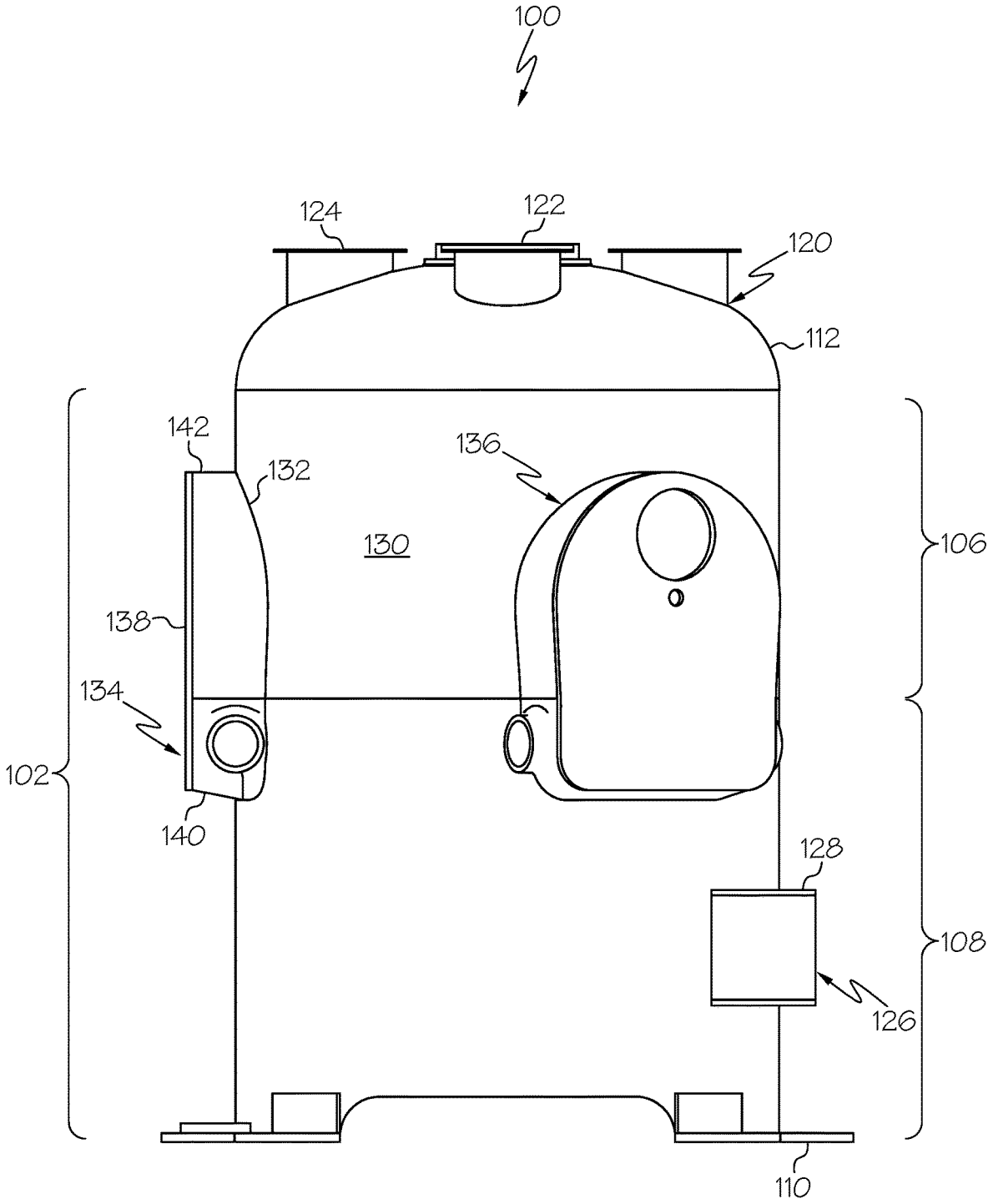
FIG. 2 depicts an illustrative front view of the enclosure for the vertical pulverizer system of FIG. 1, according to embodiments.
Figure 3:
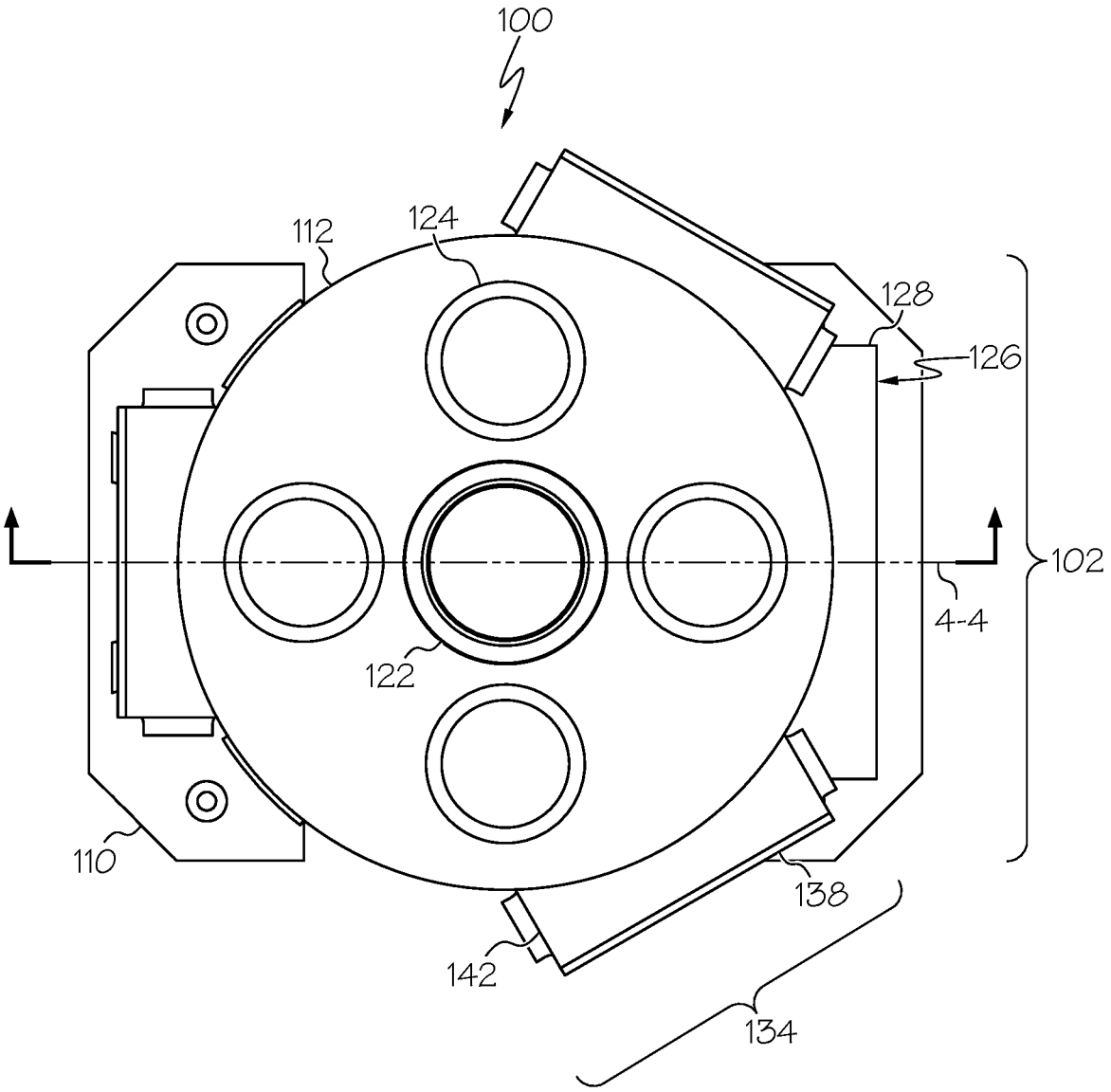
FIG. 3 depicts an illustrative top view of the enclosure for the vertical pulverizer system of FIG. 1, according to embodiments.
Figure 4A:
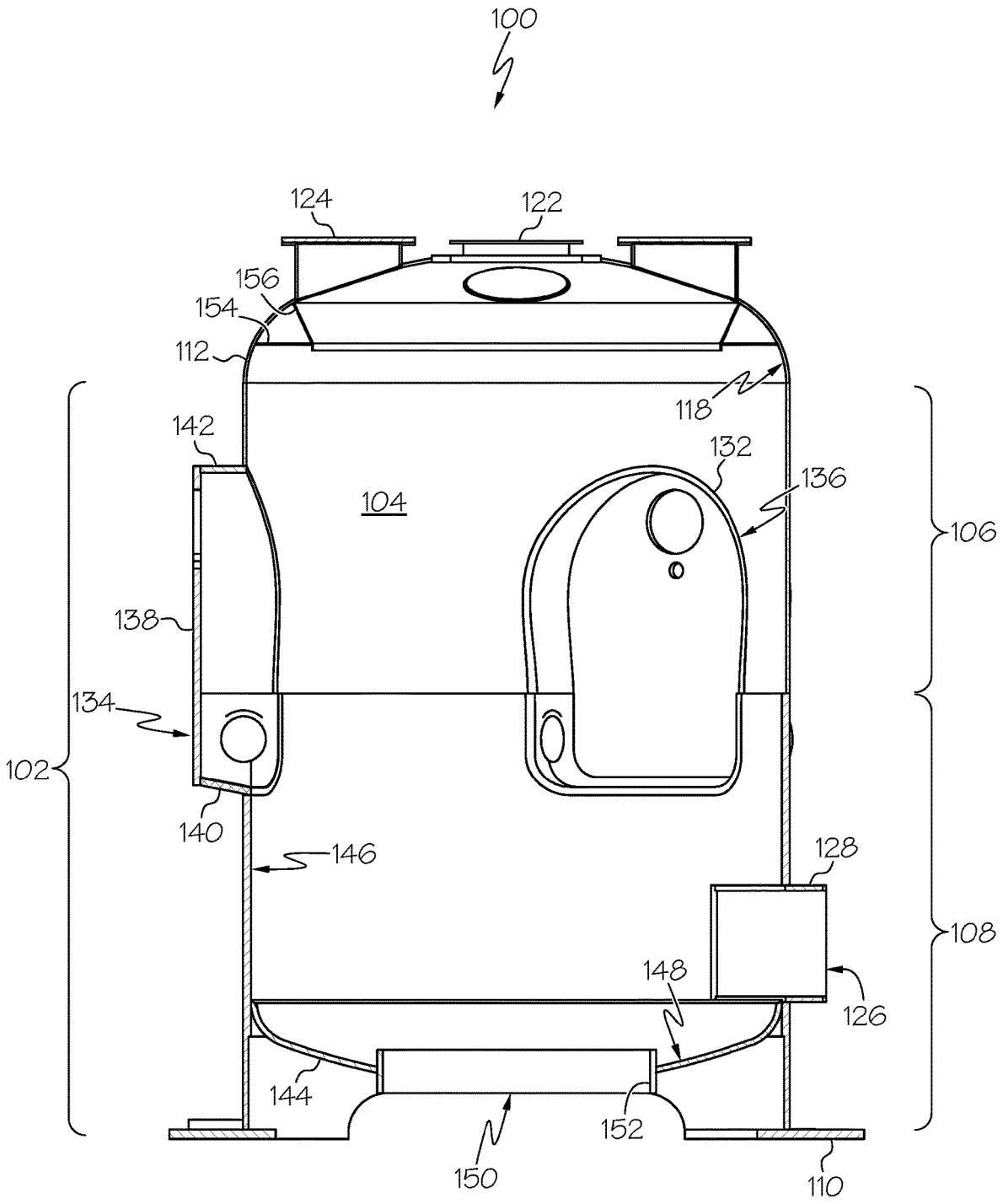
FIG. 4A depicts a cross-sectional front view of the enclosure for the vertical pulverizer system of FIG. 1 taken along line 4-4 of FIG. 3, according to embodiments.
Figure 4B:
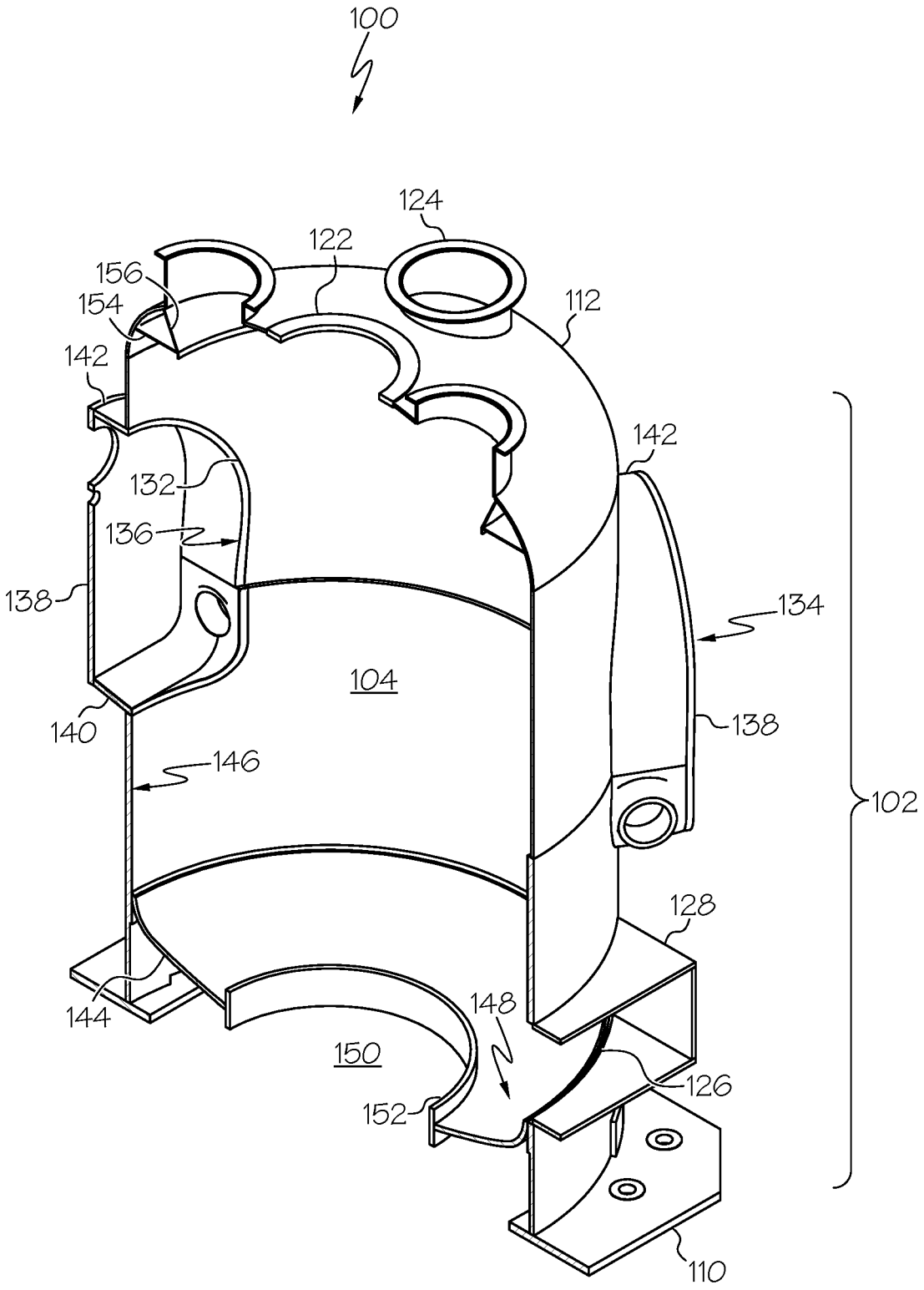
FIG. 4B depicts a cross-sectional isometric view of the enclosure for the vertical pulverizer system of FIG. 1 taken along line 4-4 of FIG. 3, according to embodiments.

FIGS. 1-4B show various distinct views of a housing or enclosure for a vertical pulverizer system, according to embodiments. Specifically, FIG. 1 shows an isometric view of enclosure 100, FIG. 2 shows a front view of enclosure 100 and FIG. 3 shows a top view of enclosure 100. Additionally, FIG. 4A shows a cross-sectional front view of enclosure 100 taken along line 4-4 in FIG. 3 and FIG. 4B shows a cross-sectional isometric view of enclosure 100 taken along line 4-4 in FIG. 3. Description of enclosure 100 and its various components and/or portions may be provided and/or discussed below with reference to any and all of FIGS. 1-4B, unless reference is made to a specific figure(s).

As shown in FIGS. 1-4B, enclosure 100 for a vertical pulverizer system (see, FIGS. 5 and 6) may include a cylindrical body 102. Cylindrical body 102 may be vertically oriented and may include substantially linear walls. As shown and discussed herein, cylindrical body 102 may form an internal cavity 104 (see, FIG. 4A) for enclosure 100 and may substantially house and/or surround various components of enclosure 100 and/or the vertical pulverizer system. In a non-limiting example shown in FIGS. 1-4B, cylindrical body 102 may include at least two distinct portions. Specifically, cylindrical body 102 may include an upper portion 106 and a lower or bowl portion 108 positioned below and/or coupled to upper portion 106. Although two portions are shown, it is understood that cylindrical body 102 may be formed from more distinct portions. In another non-limiting example, cylindrical body 102 may be formed from a single component or piece of material. Cylindrical body 102 of enclosure 100 may be formed from any material that may withstand pressure changes, excursions, mechanical stresses and/or temperature variations that may be experienced during the operation of the vertical pulverizer system, as discussed herein. In non-limiting examples, cylindrical body 102, and specifically upper portion 106 and bowl portion 108, may be formed from metal and/or metal alloys. Additionally cylindrical body 102 of enclosure 100 may be formed using any suitable material forming process or technique including, but not limited to, rolling, casting, forming and/or similar processes.

As shown in FIGS. 1-4B, enclosure 100 may also include a plurality of feet 110. Feet 110 may be positioned below cylindrical body 102 and may extend perpendicular to cylindrical body 102. In a non-limiting example shown in FIGS. 1-4B, feet 110 may be a distinct component from cylindrical body 102 and may be coupled to the bottom of bowl portion 108 of cylindrical body 102. In another non-limiting example, feet 110 may be formed integrally with cylindrical body 102, and may be formed and/or shaped to extend perpendicular to cylindrical body 102. As discussed herein, feet 110 may be coupled to a support of a vertical pulverizer system utilizing enclosure 100 to support enclosure 100 and the various components of the system positioned within enclosure 100.

Enclosure 100 may also include a cover 112 positioned above cylindrical body 102. As shown in FIGS. 1-4B, cover 112 may be coupled to cylindrical body 102, and specifically, upper portion 106 of cylindrical body 102. Cover 112 may be coupled to cylindrical body 102 to substantially close and/or form a closed end for internal cavity 104 (see, FIG. 4A) formed by cylindrical body 102 of enclosure 100. Cover 112 may be coupled to cylindrical body 102 using any suitable coupling mechanisms and/or coupling techniques. For example, cover 112 may be coupled to cylindrical body 102 using mechanical fasteners, such as bolts, or alternatively, cover 112 may be welded to cylindrical body 102. Similar to cylindrical body 102, cover 112 may be formed from any material that may withstand pressure changes, excursions, mechanical stresses and/or temperature variations that may be experienced during the operation of the vertical pulverizer system, as discussed herein. In non-limiting examples, cover 112 may be formed from metal and/or metal alloys. Additionally, cover 112, and the various components or portions of cover 112 discussed herein, may be formed using any suitable material forming process or technique including, but not limited to, rolling, casting, forming and/or similar processes.

Briefly turning to FIGS. 4A and 4B, cover 112 may include a substantially curved, non-linear and/or dome-shaped surface 118. In the non-limiting example shown in FIGS. 4A and 4B, curved surface 118 of cover 112 may be substantially concave with respect to internal cavity 104 of cylindrical body 102. Specifically, cover 112 may include an inner curved surface 118 facing and/or positioned within internal cavity 104 that may be substantially concave in shape. Curved surface 118 of cover 112 may include any non-linear geometry and/or shape including, but not limited to, torispherical, hemispherical, ellipsoidal and any other dome-shaped geometry. As shown in FIGS. 4A and 4B, curved surface 118 of cover 112 may extend completely, fully or substantially around the perimeter and/or entirety of cover 112. As discussed herein, the geometry, and specifically the curvature, of curved surface 118 of cover 112 may aid and/or improve in the particle distribution, air flow and/or pressure containment within enclosure 100 during operation of the vertical pulverizer system that utilizes enclosure 100.

Various channels may be formed through cover 112 of enclosure 100. That is, cover 112 may include various channels formed through a top portion 120 of cover 112. As shown in FIGS. 1-4B, a material inlet channel 122 may be formed through top portion 120 of cover 112. In a non-limiting example, material inlet channel 122 may be formed completely through a center (C) (see, FIG. 1) of cover 112. Additionally, material inlet channel 122 may extend away from and/or above a surface of cover 112. Material inlet channel 122 formed in cover 112 may be in fluid communication with internal cavity 104 (see, FIG. 4A) formed by cylindrical body 102. As discussed herein, material inlet channel 122 may be configured and/or utilized within the vertical pulverizer system to provide raw material (e.g., coal) to components of the vertical pulverizer system to be processed within enclosure 100. Additionally, although shown in FIGS. 1-4B as being formed through center (C) (see, FIG. 1) of cover 112, it is understood that material inlet channel 122 may be formed through any portion of cover 112 to be in fluid communication with and/or provide raw material to enclosure 100.

Cover 112 may also include at least one particle outlet channel 124. As shown in FIGS. 1-4B, particle outlet channel 124 may be formed completely through cover 112, such that particle outlet channel 124 may also be in fluid communication with internal cavity 104 formed by cylindrical body 102. Particle outlet channel 124 may be formed through top portion 120 of cover 112 adjacent material inlet channel 122. Similar to material inlet channel 122, particle outlet channel 124 may extend away from and/or above a surface of cover 112. In a non-limiting example shown in FIGS. 1-4B, cover 112 of enclosure 100 may include four (4) distinct particle outlet channels 124 formed therein. Particle outlet channels 124, as shown in FIGS. 1-4B may substantially surround and may be spaced approximately equidistant apart from material inlet channel 122 and each other, respectively. Although four particle outlet channels 124 are depicted in FIGS. 1-4B, it is understood that the number of particle outlet channels 124 shown in the figures is merely illustrative and cover 112 may include more or less particle outlet channels 124 than the number depicted and discussed herein. As discussed below, particle outlet channels 124 may be configured and/or utilized within the vertical pulverizer system to allow and/or carry processed particles of the raw material (e.g., coal) away from enclosure 100 and to a distinct power system that may utilize the vertical pulverizer system.

As shown in FIGS. 1-4B, enclosure 100 may also include a gas inlet opening 126. Gas inlet opening 126 may be formed through cylindrical body 102. Specifically, gas inlet opening 126 may be formed through bowl portion 108 of cylindrical body 102. Gas inlet opening 126 may provide access and/or fluid communication between internal cavity 104 (see, FIG. 4A) formed by cylindrical body 102 and an air system of the vertical pulverizer system, as discussed herein. An inlet cover or duct 128 may substantially surround gas inlet opening 126 formed through cylindrical body 102. As shown in FIGS. 1-4B, inlet duct 128 may be positioned on and/or coupled to an exposed or outer surface 130 of cylindrical body 102 and may extend or protrude away from cylindrical body 102. As discussed herein, inlet duct 128 may couple a gas system of the vertical pulverizer system to enclosure 100, such that the gas system may provide gas (e.g., air) within enclosure 100 via gas inlet opening 126.

Enclosure 100 may also include a journal opening 132 (see, FIG. 4A) and a journal opening cover 134 substantially covering journal opening 132. As discussed in detail herein, journal opening 132 and journal opening cover 134 may provide an opening a cover and/or support structure for a journal of the vertical pulverizer system that may be used to process raw material within enclosure 100 during operation of the vertical pulverizer system. As shown in FIGS. 1-4B, and with specific reference to FIG. 4A, journal opening 132 may be formed through cylindrical body 102, below cover 112. In a non-limiting example where cylindrical body 102 is formed from upper portion 106 and bowl portion 108, journal opening 132 may be formed through a portion of each of upper portion 106 and bowl portion 108. As a result, when upper portion 106 and bowl portion 108 are coupled together to form cylindrical body 102, journal opening 132 may be a single opening and/or aperture formed through cylindrical body 102. Journal opening 132 formed through cylindrical body 102 may include a substantially curved and/or contoured geometry 136. That is, and with reference to FIGS. 4A and 4B, journal opening 132 may be formed to include substantially curved and/or contoured geometry 136. In the non-limiting example, the curved and/or contoured geometry 136 of journal opening 132 may include a substantially linear base, substantially linear sides and a substantially curved top portion connected to both sides. Additionally in the non-limiting example, the transitions between the base and sides may be substantially curved, smooth and/or non-angular. As discussed herein, the curved geometry 136 of journal opening 132 may aid and/or improve the effects of temperature change, air flow and/or pressure containment within enclosure 100 during operation of the vertical pulverizer system that utilizes enclosure 100.

In the non-limiting example shown in FIGS. 1-4B, enclosure 100 may include three distinct journal openings 132 formed through cylindrical body 102. However, it is understood that the number of depicted journal openings 132 formed through cylindrical body 102 may be merely exemplary and may not be considered limiting. As discussed herein, journal opening 132 formed through cylindrical body 102 may provide access to internal cavity 104 (see, FIG. 4A) formed by cylindrical body 102 and/or components utilized by the vertical pulverizer system that may be positioned within cylindrical body 102 and substantially through and/or within journal opening 132.

As shown in FIGS. 1-4B, journal opening cover 134 may be coupled to cylindrical body 102. Specifically, journal opening cover 134 may be coupled to and extend away from an outer surface of cylindrical body 102. Journal opening cover 134 may substantially cover journal opening 132 and may prevent undesired exposure and/or access to internal cavity 104 (see, FIG. 4A) of cylindrical body 102 via journal opening 132. As discussed herein, journal opening cover 134, and the various components forming journal opening cover 134 discussed below, may be designed, configured and/or formed to include unique features and/or geometries to aid and/or improve the effects of temperature change, air flow and/or pressure containment within enclosure 100 during operation of the vertical pulverizer system that utilizes enclosure 100.

In the non-limiting example shown in FIGS. 1-4B, journal opening 132 may include a door 138 configured to provide access to internal cavity 104 of cylindrical body 102, a trunnion support 140 positioned adjacent and below door 138 and a curved side wall 142 positioned substantially perpendicular to door 138. Door 138 may be coupled to both trunnion support 140 and curved side wall 142, respectively. In a non-limiting example, door 138 may be releasably coupled to trunnion support 140 and/or curved side wall 142. As a result, door 138 may be released, removed, hinged and/or otherwise uncoupled from trunnion support 140 and/or curved side wall 142 to provide access to internal cavity 104 and/or the components of the vertical pulverizer system that are positioned within cylindrical body 102. In other non-limiting examples discussed herein where components of the vertical pulverizer system are attached and/or coupled to door 138, door 138 may be uncoupled and/or hinged to at least partially remove the components of the vertical pulverizer system from enclosure 100. As shown in FIGS. 1-4B, and as discussed below, door 138 may be formed to substantially match or mirror the shape and/or geometry of journal opening 132 and/or curved side wall 142. That is, door 138 of journal opening cover 134 may formed to include a perimeter shape or geometry that includes substantially curved portions that match the geometry or shape of journal opening 132 and/or the geometry of curved side walls 142.

Trunnion support 140 of journal opening cover 134 may be positioned below and adjacent door 138, and may be coupled to door 138. As shown in FIGS. 1-4B, and with specific reference to FIGS. 2 and 4A, trunnion support 140 may be coupled directly to cylinder body 102 and may extend from outer surface 130 of cylinder body 102. In a non-limiting example, trunnion support 140 may angularly extend away from outer surface 130 of cylinder body 102 toward door 138. As discussed herein, the angular orientation, positioning and/or formation of trunnion support 140 may aid and/or improve the effects of temperature change, air flow and/or pressure containment within enclosure 100 during operation of the vertical pulverizer system that utilizes enclosure 100.

Curved side wall 142 of journal opening cover 134 may be coupled to and extend perpendicularly from outer surface 130 of cylinder body 102. Additionally, curved side wall 142 may be positioned between door 138 and cylindrical body 102, and may be positioned substantially perpendicular to door 138 of journal opening cover 134 as well. Curved side wall 142 may also be coupled to trunnion support 140. As a result, curved side wall 142 and trunnion support 140 may for the sidewalls for journal opening cover 134. As shown in FIGS. 1-4B, and specifically FIGS. 2 and 4A, curved side wall 142 may be formed to include a shape or geometry that includes substantially curved portions that match the geometry or shape of journal opening 132. That is, the geometry and/or shape of curved side wall 142 of journal opening cover 134 may substantially match and/or mirror the curved and/or contoured geometry 136 of journal opening 132. The curved and/or contoured geometry of curved side wall 142, along with the geometry and/or angular orientation of door 138 and trunnion support 140, may aid and/or improve the effects of temperature change, air flow and/or pressure containment within enclosure 100 during operation of the vertical pulverizer system that utilizes enclosure 100, as discussed herein.

Turning to FIGS. 4A and 4B, additional components of enclosure 100 are discussed. As shown in FIGS. 4A and 4B, enclosure 100 may also include base component 144. Base component 144 may be positioned within internal cavity 104 of cylindrical component 102, opposite cover 112. Specifically, base component 144 may be positioned within bowl portion 108 of cylindrical body 102 and may be positioned below upper portion 106, cover 112 and journal opening cover 134. Additionally, base component 144 may be positioned adjacent and/or below gas inlet opening 126 formed through bowl portion 108 of cylinder body 102. As shown in FIGS. 4A and 4B, cylindrical body 102 extends below base component 144 and cylindrical body 102 may substantially surround base component 144, such that base component 144 may not be visible when enclosure 100 is assembled.

As shown in FIG. 4A, base component 144 may be coupled to an inner surface 146 of cylindrical body 102. Base component 144 may be coupled to inner surface 146 of cylindrical body 102 using any suitable coupling mechanisms and/or coupling techniques. For example, base component 144 may be coupled to cylindrical body 102 using mechanical fasteners, such as bolts, or alternatively, base component 144 may be welded to cylindrical body 102. Similar to cylindrical body 102 and/or cover 112 discussed herein, base component 144 may be formed from any material that may withstand pressure changes, excursions, mechanical stresses and/or temperature variations that may be experienced during the operation of the vertical pulverizer system, as discussed herein. In non-limiting examples, base component 144 may be formed from metal and/or metal alloys. Base component 144 may be formed using any suitable material forming process or technique including, but not limited to, rolling, casting, forming and/or similar processes.

Similar to cover 112, base component 144 may include a substantially curved, non-linear and/or dome-shaped surface 148. In the non-limiting example shown in FIGS. 4A and 4B, curved surface 148 of base component 144 may be substantially concave with respect to internal cavity 104 of cylindrical body 102. Curved surface 148 may include any non-linear geometry and/or shape including, but not limited to, torispherical, hemispherical and ellipsoidal. Also similar to curved surface 118 of cover 112, and as shown in FIGS. 4A and 4B, curved surface 148 of base component 144 may extend completely, fully or substantially around the perimeter and/or entirety of base component 144. As discussed herein, the geometry and/or shape of curved surface 148 of base component 144 may aid and/or improve the effects of temperature change, air flow and/or pressure containment within enclosure 100 during operation of the vertical pulverizer system that utilizes enclosure 100. Additionally, the geometry and/or shape of curved surface 148 of base component 144 may aid in the collection of rejected raw material processed by the vertical pulverizer system, as discussed herein.

As shown in FIGS. 4A and 4B, base component 144 may also include an aperture 150 formed substantially through base component 144. Aperture 150 may be formed through the center of base component 144 and may substantially receive a portion of a rotatable table of the vertical pulverizer system (see, FIG. 5) utilizing enclosure 100. Aperture 150 of base component 144 may be substantially aligned with a bottom seal 152. That is, bottom seal 152 may be coupled and may line aperture 150 of base component 144. As discussed herein, bottom seal 152 may prevent gas (e.g., air) provided to cylindrical body 102 via gas inlet opening 126 from leaking out of cylindrical body 102 between base component 144 and the rotatable table of the vertical pulverizer system. In another non-limiting example, bottom seal 152 may prevent raw material that is discharged and/or discarded from the rotatable table from falling out of enclosure 100 and/or into distinct portions of the vertical pulverizer system that may be damaged by the discharged and/or discarded raw material.

Cover 112 may also include a top seal 154. As shown in FIGS. 4A and 4B, top seal 154 may be positioned on and/or may extend inwardly from curved surface 118 of cover 112. Top seal 154 may be coupled to curved surface 118 of cover 112 and may extend inward to form a seal around a particle screening device of the vertical pulverizer system that may utilize enclosure 100, as discussed herein. Additionally, and as discussed herein, top seal 154 may form a partial "roof" that may surround the particle screening device of the vertical pulverizer system to ensure that all particles of raw material that are processed by the vertical pulverizer system are moved through the particle screening device before exiting enclosure 100.

As shown in FIGS. 4A and 4B, cover 112 may also include a particle deflection component 156. Particle deflection component 156 may be positioned above and extend from top seal 154 toward particle outlet channels 124 formed in cover 112. In the non-limiting example shown in FIGS. 4A and 4B, particle deflection component 156 may extend angularly toward particle outlet channels 124 to form a ramp that may guide the particles of the processed raw material by the vertical pulverizer system through the cover 112 to particle outlet channels 124. As shown in FIGS. 4A and 4B, particle deflection component 156 positioned within cover 112 may not be wider and/or may not extend beyond particle outlet channels 124 to ensure particles moving through cover 112 do not get trapped within cover 112, as discussed herein.

Figure 5:
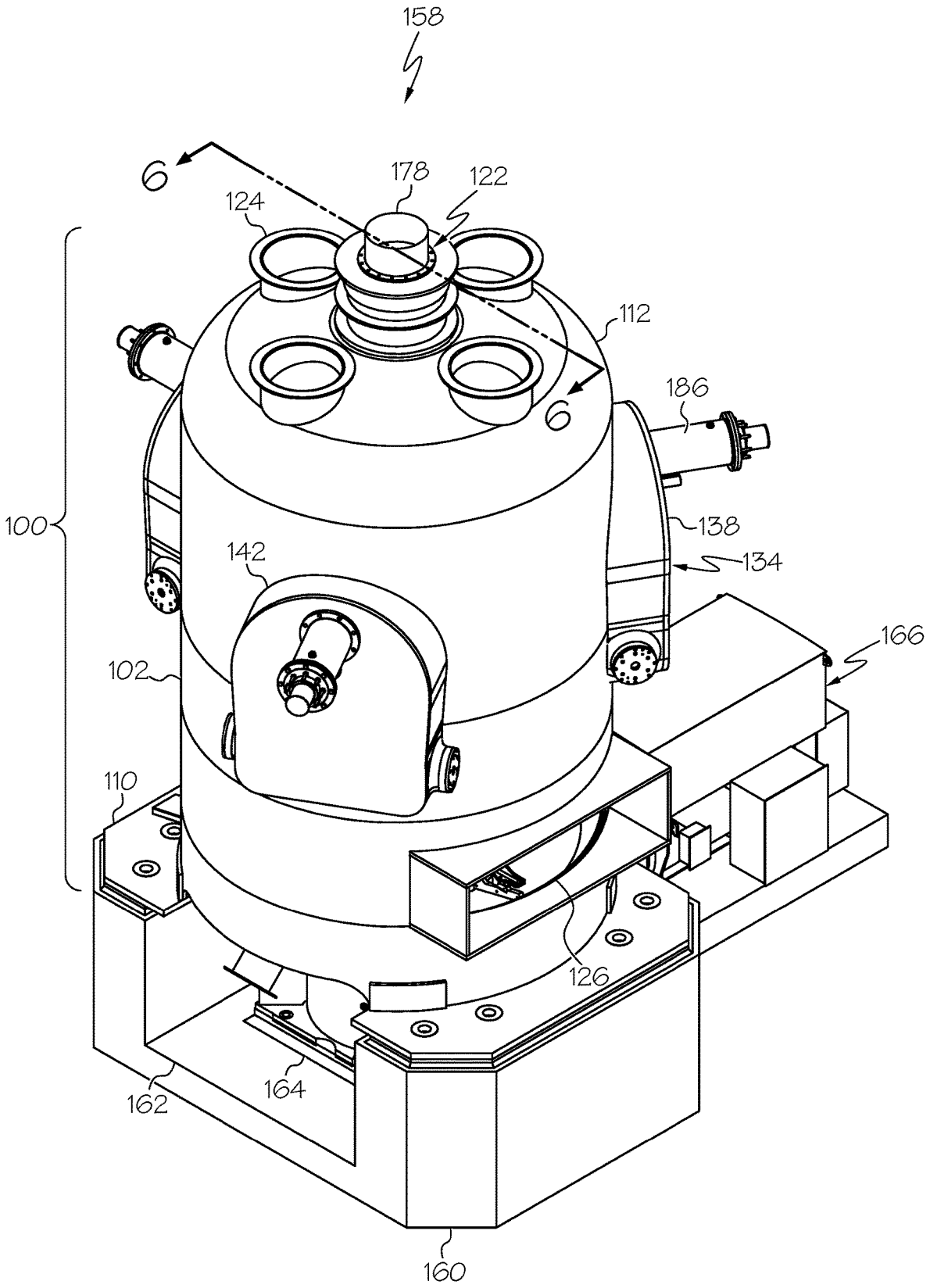
FIG. 5 depicts an isometric view of a vertical pulverizer system including the enclosure of FIG. 1, according to embodiments.
Figure 6:
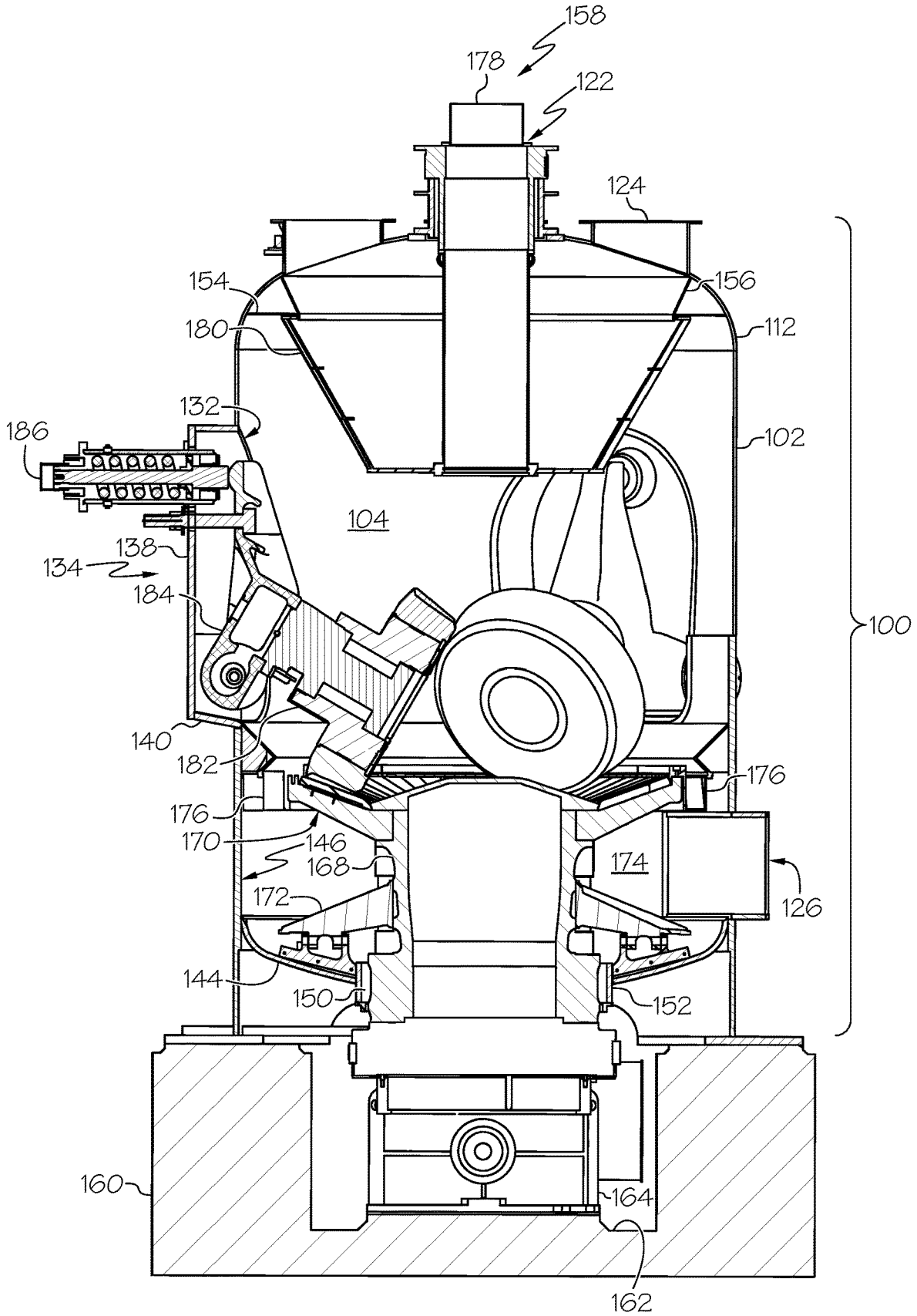
FIG. 6 depicts a cross-sectional front view of the vertical pulverizer system including the enclosure of FIG. 1 taken along line 6-6 of FIG. 5, according to embodiments.

FIGS. 5 and 6 show distinct views of a vertical pulverizer system 158 that may utilize enclosure 100 as shown and discussed herein with respect to FIGS. 1-4B. Specifically, FIG. 5 shows an isometric view of vertical pulverizer system 158 including enclosure 100, and FIG. 6 shows a cross-sectional front view of vertical pulverizer system 158 including enclosure 100 taken along line 6-6 in FIG. 5. It is understood that similarly numbered and/or named components may function in a substantially similar fashion. Redundant explanation of these components has been omitted for clarity.

As shown in FIGS. 5 and 6, enclosure 100 may be positioned above and/or coupled to a stationary support 160 of vertical pulverizer system 158. Specifically, feet 110 of enclosure 100 may be coupled directly to support 160 to affix enclosure 100 to support 160 during the operation of vertical pulverizer system 158. Support 160 may also include a recess or seat 162 formed therein. Seat 162 may be formed partially through support 160, and between feet 110 of enclosure 100. In a non-limiting example shown in FIGS. 5 and 6, when enclosure 100 is coupled to support 160, at least a portion of internal cavity 104 of cylindrical body 102, cover 112 and/or base component 144 may be in substantially alignment with and/or positioned above seat 162 formed in support 160. Additionally, and with reference to FIG. 6, aperture 150 formed through base component 144 may be in substantial alignment with seat 162 of support 160.

A gearbox 164 of vertical pulverizer system 158 may be positioned within seat 162 of support 160. More specifically, gearbox 164 may be positioned coupled and/or affixed within seat 162 of support 160. In a non-limiting example shown in FIGS. 5 and 6, gearbox 164 may be a planetary gearbox that may be configured to rotate distinct components (e.g., rotatable table) of vertical pulverizer system 158 when processing raw material, as discussed herein. Gearbox 164 may be coupled to a drivetrain system 166 (see, FIG. 5) of vertical pulverizer system 158. Drivetrain system 166 may be coupled to gearbox 164 to drive, provide power, and/or rotate gearbox 164 during operations of vertical pulverizer system 158.

Referring primarily to FIG. 6, and with continued reference to FIG. 5, vertical pulverizer system 158 may also include rotatable table 168 at least partially positioned within internal cavity 104 formed by cylindrical body 102. Rotatable table 168 may be coupled to gearbox 164 and may be configured to rotate with gearbox 164. That is, rotatable table 168 may be coupled to gearbox 164, such that during operations of vertical pulverizer system 158, gearbox 164 may rotate and/or turn rotatable table 168. As shown in FIG. 6, and as discussed herein, rotatable table 168 may be positioned and/or may extend through aperture 150 formed in base component 144 to be positioned within enclosure 100. Additionally, the portion of rotatable table 168 that may be positioned and/or through aperture 150 of base component 144 may be contacted, sealed and/or separated from base component 144 via bottom seal 152. As discussed herein, bottom seal 152 coupled to base component 144, and positioned between rotatable table 168 and base component 144, may prevent rejected, discharged and/or discarded raw material processed using vertical pulverizer system 158 from falling out of enclosure 100 and into gearbox 164 and/or seat 162 of support 160.

Rotatable table 168 may include a grinding platform 170 positioned within internal cavity 104 of enclosure 100. Grinding platform 170 may be positioned above base component 144 and below journal opening cover 134. Additionally, grinding platform 170 may be positioned below cover 112, and may be aligned with material inlet channel 122 formed in cover 112. As shown in FIG. 6, grinding platform 170 of rotatable table 168 may extend nearly the entire width of cylindrical body 102. However, a separation or space may be formed between an end of grinding platform 170 of rotatable table 168 and inner surface 146 of cylindrical body 102 so additional components (e.g., vane wheel assembly) may be positioned between grinding platform 170 and cylindrical body 102, as discussed herein. As discussed herein, raw material (e.g., coal) may be deposited onto grinding platform 170 of rotatable table 168 for processing by vertical pulverizer system 158.

A scraper 172 may also be coupled to rotatable table 168. As shown in FIG. 6, scraper 172 may be coupled to rotatable table 168 below grinding platform 170. Additionally, scraper 172 coupled to rotatable table 168 may be positioned above base component 144. As a result of being coupled to rotatable table 168, scraper 172 may rotate with rotatable table 168 during operations of vertical pulverizer system 158. Scraper 172 may rotate with rotatable table 168 to move rejected, discharged and/or discarded raw material toward a material chute (not shown) to be removed from the area 174 within enclosure 100 formed between base component 144 and grinding platform 170 of rotatable table 168. As discussed herein, rejected, discharged and/or discarded raw material may fall from grinding platform 170 of rotatable table 168 to area 174 during operations of vertical pulverizer system 158.

A vane wheel assembly 176 may be positioned between cylindrical body 102 and grinding platform 170 of rotatable table 168. As shown in FIG. 6, vane wheel assembly 176 may substantially surround grinding platform 170 and may provide a space, separation and/or opening between grinding platform 170 and cylindrical body 102 of enclosure 100. In a non-limiting example, vane wheel assembly 176 may be coupled to grinding platform 170 and may rotate with grinding platform 170 and/or rotatable table 168. In another non-limiting example, vane wheel assembly 176 may be coupled to inner surface 146 of cylindrical body 102 and remain static as grinding platform 170 and/or rotatable table 168 rotate within enclosure 100. As discussed herein, during operation of vertical pulverizer system 158, vane wheel assembly 176 may provide a passage for hot gas (e.g., air) to flow up to grinding platform 170 to flash-dry the raw material on grinding platform 170, as well as, provide a passage to allow rejected, discharged and/or discarded raw material to fall from grinding platform 170 to area 174.

Raw material may be supplied to vertical pulverizer system 158 via a material feed pipe 178. As shown in FIGS. 5 and 6, material feed pipe 178 may be coupled to material inlet channel 122 formed in cover 112. Specifically, and with reference to FIG. 6, material feed pipe 178 may be coupled to, position within and/or positioned through material inlet channel 122 of cover 112. Material feed pipe 178 may also extend into internal cavity 104 of cylindrical body 102 of enclosure 100, and may be positioned above grinding platform 170 of rotatable table 168. Material feed pipe 178 may extend through and/or beyond various components of vertical pulverizer system 158. In a non-limiting example shown in FIG. 6, material feed pipe 178 may extend completely through and/or beyond cover 112 into cylindrical body 102. Additionally in the non-limiting example shown in FIG. 6, material feed pipe 178 may extend at least partially through a particle screening device 180 of vertical pulverizer system 158 positioned within enclosure 100.

Particle screening device 180 (e.g., classifier) shown in FIG. 6 may be positioned within enclosure 100, and may be coupled to at least one of cover 112, cylindrical body 102 and/or top seal 154 of enclosure 100. At least a portion of particle may extend into internal cavity 104 of cylindrical body 102, above grinding platform 170 of rotatable table 168. As discussed herein, top seal 154 coupled to and/or extending from cover 112 may substantially surround and/or seal particle screening device 180 of vertical pulverizer system 158, and may prevent processed particles of the raw material within vertical pulverizer system 158 from passing into cover 112 without first passing through particle screening device 180. Particle screening device 180 may be configured to receive processed particles of raw material and screen and/or filter the particles to determine if the particles meet a characteristic threshold(s) (e.g., size) to pass through particle screening device 180 and ultimately out of enclosure 100 via particle outlet channels 124 of cover 112. Particle screening device 180 may be any suitable particle screening device that may screen the particles processed using vertical pulverizer system 158. In a non-limiting example shown in FIG. 6, particle screening device 180 may include a dynamic classifier or screening device. In another non-limiting example shown in FIG. 7, and discussed below, particle screening device 180 may include a static classifier or screening device.

Vertical pulverizer system 158 may also include a journal 182 positioned within enclosure 100. As shown in FIG. 6, journal 182 may be positioned within internal cavity 104, adjacent journal openings 132 and/or journal opening covers 134. Additionally, journal 182 may be positioned above rotatable table 168, and below cover 112. Specifically, journal 182 may be positioned directly adjacent grinding platform 170 of rotatable table 168. Journal 182 may be positioned directly adjacent grinding platform 170 such that a minimal space or distance may exist between grinding platform 170 and journal 182 to allow raw material to pass under and/or be ground by journal 182. In a non-limiting example, journal 182 may be configured to rotate and may contact, grind and/or crush raw material on grinding platform 170 of rotatable table 168 into a desired particle size.

Although only one journal 182 is shown in FIG. 6, it is understood that vertical pulverizer system 158 may include more journals 182. That is, it is understood that the number of depicted journals 182 included in vertical pulverizer system 158 may be merely illustrative and may not be considered limiting. Additionally, the number of journals 182 in vertical pulverizer system 158 may or may not directly correlate to the number of journal openings 132 and/or journal opening covers 134 included within enclosure 100. For example, and as shown in FIG. 5, enclosure 100 may include three (3) journal openings 132 and/or journal opening covers 134. As a result, vertical pulverizer system 158 may include three (3) journals 182 to match the number of journal openings 132 and/or journal opening covers 134. Alternatively, vertical pulverizer system 158 may include one (1) or two (2) journals 182 positioned adjacent and/or within only a portion of journal openings 132 and/or journal opening covers 134 in enclosure 100.

As shown in FIG. 6, journal 182 may be suspended and/or supported within enclosure 100 via trunnion 184 positioned adjacent journal opening cover 134. Trunnion 184 may be coupled to journal 182, and may be configured to adjust the angle of journal 182 within enclosure 100, which may in turn adjust the distance between grinding platform 170 of rotatable table 168 and journal 182. In a non-limiting example shown in FIG. 6, trunnion 184 may also be positioned on, coupled to and/or supported by trunnion support 140 of journal opening cover 134. Additionally in the non-limiting example, at least a portion of trunnion 184 may be positioned within internal cavity 104 of cylindrical body 102. That is, and as shown in FIG. 6, a center of trunnion 184 may be in substantial alignment with journal opening 132 formed in cylindrical body 102, or alternatively the center of trunnion 184 may be positioned within internal cavity 104 of enclosure 100. As such, a portion of trunnion 184 may extend into journal opening cover 134 and a distinct portion of trunnion 184 may extend into internal cavity 104 of enclosure 100. By positioning a portion, a majority and/or the center of trunnion 184 within internal cavity 104, the journal 182 coupled to trunnion 184 may be smaller is size, more easily adjusted (e.g., angularly) toward grinding platform 170, and/or journal 182 and trunnion 184 may require less space (e.g., width, height) within enclosure 100. Additionally, the positioning and/or orientation of trunnion 184 may allow for a smaller or lower clearance for journal 182 through journal opening 132 when journal 182 is removed from enclosure 100 for maintenance and/or inspection, as discussed herein. As a result, journal opening 132, journal opening cover 134 and ultimately enclosure 100 may be smaller in size (e.g., height, width, circumference), require less material and/or time for manufacturing and assembly.

Additionally as shown in FIGS. 5 and 6, vertical pulverizer system 158 may also include a journal spring assembly 186. Journal spring assembly 186 may be coupled to door 138 of journal opening cover 134 of enclosure 100. More specifically, journal spring assembly 186 may be coupled to and/or positioned partially through an opening formed in door 138 of journal opening cover 134. As a result, a portion of journal spring assembly 186 positioned through door 138 may be positioned within journal opening cover 134. In a non-limiting example shown in FIG. 6, journal spring assembly 186 may not extend beyond journal opening 132 formed in cylindrical body 102 of enclosure 100. Journal spring assembly 186 may be coupled to journal 182 and/or trunnion 184 and may be configured to apply a load to journal 182 of vertical pulverizer system 158 to ensure raw material is processed within vertical pulverizer system 158. Additionally, and as discussed herein, journal spring assembly 186 may be configured to provide "give," shock absorption and/or allow for temporary displacement of journal 182 during the raw material grinding process.

Operations and processes performed by vertical pulverizer system 158 are now discussed. Initially, raw material (e.g. coal) may be provided to enclosure 100 via material feed pipe 178. The raw material may be moved into enclosure 100 via material feed pipe 178 and deposited onto grinding platform 170 of rotatable table 168. The deposited raw material may rotate with grinding platform 170 of rotatable table 168 and may pass under rotating journal 182 to be ground, crushed and/or pulverized. Simultaneous to the grinding process performed by journal 182, high-temperature gas (e.g., air) may be provided to area 174 of enclosure 100 via gas inlet opening 126. The high-temperature gas may flow from area 174 to the raw material on grinding platform 170 via vane wheel assembly 176 to flash-dry the raw material rotating on grinding platform 170. Raw material that is not adequately and/or capable of being ground (e.g., to big, too hard, impure) may be rejected, discharged and/or discarded from grinding platform 170 of rotatable table 168 and may fall to area 174 through vane wheel assembly 176. Once the rejected, discharged and/or discarded raw material is positioned within area 174, scraper 172 coupled to rotatable table 168 may push and/or move the discarded raw material to a chute (not shown) to remove the material from area 174 and prevent build-up material. As discussed herein, discarded raw material that is not yet moved by scraper 172 may remain within area 174 and may not fall below base component 144 and/or enclosure 100, including seat 162 of support 160, because of bottom seal 152 positioned between aperture 150 of base component 144 and rotatable table 168.

Raw material that is not rejected, discharged and/or discarded may remain on grinding platform 170 of rotatable table 168 and may be ground and dried as discussed herein. Once the raw material reaches particle size it may move (e.g., float, blown) upwards from grinding platform toward cover 112. In a non-limiting example, a suction may be applied within enclosure to move and/or draw the raw material particles toward cover 112. These raw material particles may move toward top seal 154 and particle screening device 180. The raw material particles that move toward top seal 154 may contact top seal 154 and either fall back toward grinding platform 170, or may move toward particle screening device 180. As discussed herein, top seal 154 may prevent raw material particles from exiting enclosure 100 without passing through particle screening device 180. The raw material particles that may reach particle screening device 180 may undergo a screen process to determine if the particles meet a characteristic threshold(s) (e.g., size) to pass through particle screening device 180. If the particles do not meet the characteristic threshold, the material particles may be forced down to grinding platform 170 to undergo further grinding and/or drying. If the particles meet the characteristic threshold, the raw material particles are moved through cover 112, distributed to particle outlet channels 124 and ultimately provided to another component (e.g., a boiler) of a power generation system that utilized vertical pulverizer system 158. As discussed herein, the curved or concave surface of cover 112 may aid in distributing the raw material particles into particle outlet channels of cover 112. Additionally, particle deflection component 156 positioned above particle screening device 180 may aid in distributing the raw material particles into particle outlet channels of cover 112 and/or may prevent raw material particles from becoming trapped and/or clogging cover 112 of enclosure 100.

Figure 7:
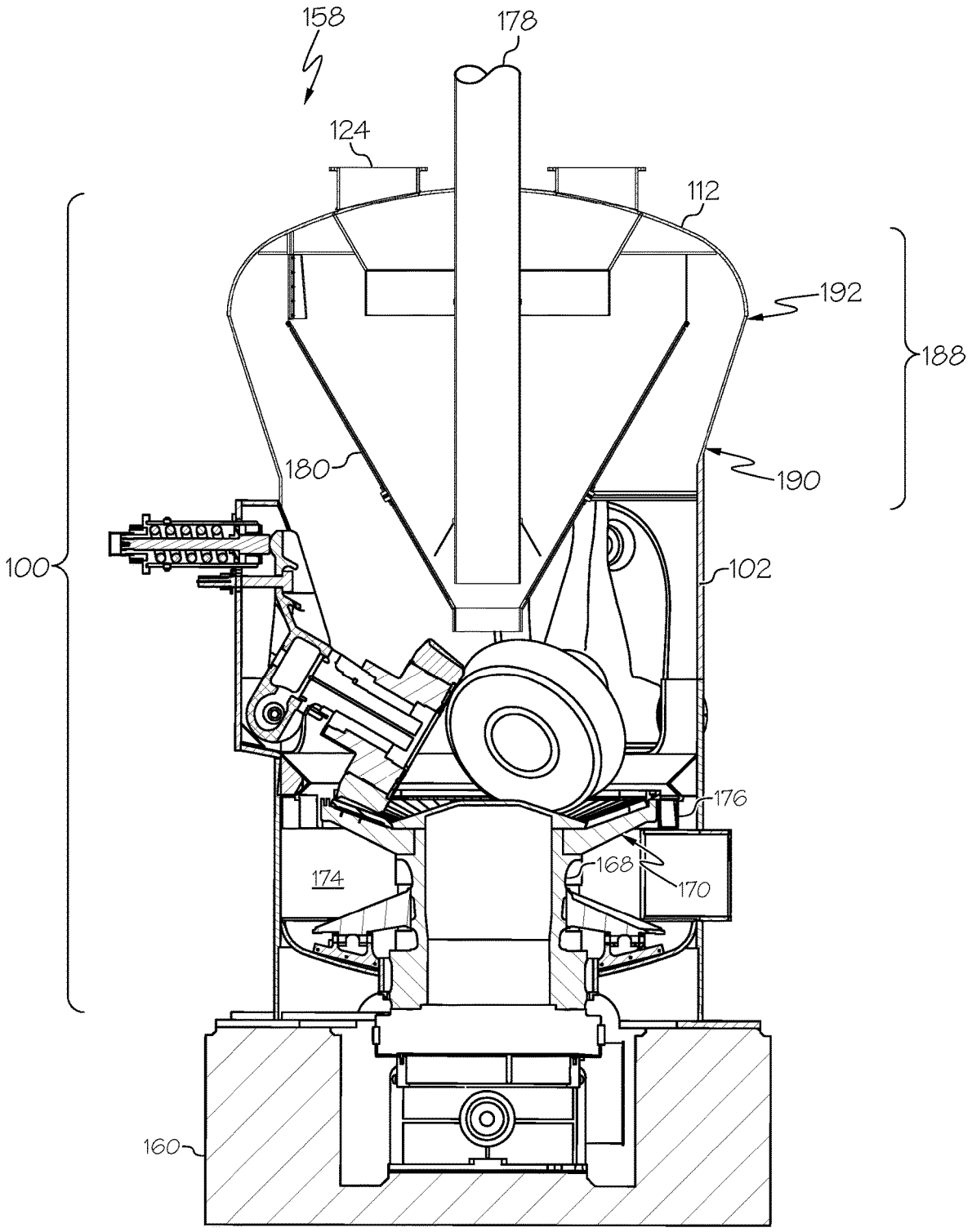
FIG. 7 depicts a cross-sectional front view of a vertical pulverizer system including an enclosure, according to additional embodiments.

FIG. 7 shows vertical pulverizer system 158 including some distinct components from those discussed herein with respect to FIGS. 1-6. Although some components in vertical pulverizer system 158 shown in FIG. 7 are distinct, it is understood that similarly numbered and/or named components may function in a substantially similar fashion. Redundant explanation of these components has been omitted for clarity.

As shown in FIG. 7, and as discussed herein, particle screening device 180 may include a distinct screening device. Specifically, particle screening device 180 shown in FIG. 7 may be a static screening device that may be configured to screen raw material particles processed by vertical pulverizer system 158. Static particle screening device 180 may achieve the same goal and/or function as particle screening device 180 discussed herein with respect to FIG. 6. That is, static particle screening device 180 shown in FIG. 7 may screen raw material particles to determine if the particles meet a characteristic threshold(s) (e.g., size) to pass through particle screening device 180 and ultimately out of enclosure 100 of vertical pulverizer system 158.

Distinct from vertical pulverizer system 158, and specifically enclosure 100, discussed herein with respect to FIGS. 1-6, enclosure 100 shown in FIG. 7 may include a frustoconical component 188. Frustoconical component 188 may be positioned above cylindrical body 102 and below cover 112. Specifically, frustoconical component 188 may be positioned between and may be coupled to cylindrical body 102 and cover 112 to form enclosure 100 of vertical pulverizer system 158. As shown in FIG. 7, a first end 190 may be coupled directly to cylindrical body 102 and a second end 192 may be coupled to cover 112. Frustoconical component 188 may be substantially tapered such that second end 192 of frustoconical component 188 is larger and/or wider than first end 190. Frustoconical component 188 may be included in enclosure 100 of vertical pulverizer system 158 for a variety of purposes and/or functions. In a non-limiting example, frustoconical component 188 may be included in enclosure 100 to add additional area, space and/or height to enclosure 100 to compensate for the size of static particle screening device 180. In another non-limiting example, frustoconical component 188 may be included in enclosure 100 to add additional area, space and/or height to enclosure 100 to allow more room for static particle screening device 180 to adequately screen the raw material particles formed in vertical pulverizer system 158.

As discussed herein, the shapes, geometries and/or configuration of the various components of the enclosure, and the enclosure itself, of the vertical pulverizer system are created, produced and/or manufactured to reduce the cost and/or manufacturing time for the enclosure. Furthermore, the enclosure and its various components discussed herein may also increase performance, functionality and/or maintenance of the enclosure and/or the vertical pulverizer system. In a non-limiting example, the enclosure discussed herein may be smaller than conventional pulverizer system enclosures, which ultimately results in less material required to build and requires less constructing and building time for the enclosure. Additionally, the shapes, geometries and/or configuration the enclosure and its various components are also created, produced and/or manufactured to withstand the pressures, changes and/or stresses typically experienced when processing raw material using a vertical pulverizer system. In a non-limiting example, the geometry and/or shape (e.g., curves) of the cover, the base component, the journal opening and/or the journal opening cover, and the joints formed there between, aid in alleviating the pressure, explosive loads, mechanical loads and/or thermal loads/gradients that may be experienced within the enclosure.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not target to be exhaustive or to limit the embodiments to the precise forms disclosed. It will be apparent to one of ordinary skill in the art that many modifications and variations are possible in view of the above teachings.

We claim:

1. An enclosure comprising:
- a cylindrical body forming an internal cavity, the cylindrical body being vertically oriented;
- a cover positioned above the cylindrical body, the cover having a curved surface that is concave in shape with respect to the internal cavity of the cylindrical body;
- an inlet channel formed through the cover, the inlet channel in fluid communication with the internal cavity of the cylindrical body;
- an outlet channel formed through the cover, and adjacent to the inlet channel;
- a base component positioned within the internal cavity of the cylindrical body opposite the cover, the base component including:
  - an aperture formed through the base component, the aperture configured to receive a rotatable table of a vertical pulverizer system, and
  - a curved surface that is concave in shape with respect to the internal cavity of the cylindrical body, the curved surface extending over the entirety of the base component from a first end of the base component coupled directly to an inner surface of the cylindrical body to a second end of the base component defining the aperture formed through the base component;
- a journal opening formed through the cylindrical body between the cover and the base component; and
- a journal opening cover coupled to the cylindrical body, the journal opening cover covering the journal opening.

2. The enclosure of claim 1, further comprising a bottom seal coupled to and lining the aperture of the base component.

3. The enclosure of claim 1, wherein the curved surface of the cover extends over the entirety of the cover.

4. The enclosure of claim 1, wherein the journal opening cover further comprises:
- a door configured to provide access to the internal cavity of the cylindrical body;
- a trunnion support positioned adjacent and below the door, the trunnion support angularly extending away from the cylindrical body; and
- a curved side wall positioned perpendicular to the door, the curved side wall coupled directly to the cylindrical body and the trunnion support.

5. An enclosure comprising:
- a cylindrical body forming an internal cavity, the cylindrical body being vertically oriented;
- a cover coupled to the cylindrical body, the cover including:
  - a concave surface with respect to the internal cavity of the cylindrical body;
  - a material inlet channel formed through the cover; and
  - a particle outlet channel formed through the cover, and adjacent to the material inlet channel;
- a base component positioned within the internal cavity of the cylindrical body opposite the cover, the base component including:
  - an aperture formed through the base component, the aperture configured to receive a rotatable table of a vertical pulverizer system, and
  - a concave surface with respect to the internal cavity of the cylindrical body, the concave surface extending over the entirety of the base component from a first end of the base component coupled directly to an inner surface of the cylindrical body to a second end of the base component defining the aperture formed through the base component;
- a curved journal opening formed through the cylindrical body between the cover and the base component; and
- a journal opening cover coupled to the cylindrical body and covering the curved journal opening, the journal opening cover including:
  - a door configured to provide access to the internal cavity of the cylindrical body;
  - a trunnion support positioned adjacent and below the door, the trunnion support angularly extending away from the cylindrical body; and
  - a curved side wall positioned perpendicular to the door, the curved side wall coupled directly to the cylindrical body and the trunnion support.

6. The enclosure of claim 5, wherein the cylindrical body extends below and surrounds the base component.

7. The enclosure of claim 5, wherein the cylindrical body further comprises:
- an upper portion coupled to the cover; and
- a bowl portion coupled to the upper portion, opposite the cover, the bowl portion including the base component.

8. The enclosure of claim 7, further comprising a gas inlet opening formed through the bowl portion of the cylindrical body, the gas inlet opening positioned above the base component.

9. The enclosure of claim 5, further comprising a top seal positioned on and extending from the cover.

10. The enclosure of claim 9, further comprising a particle deflection component extending from the top seal toward the particle outlet channel of the cover.

11. A vertical pulverizer system comprising:

a support including a seat;

a gearbox positioned within the seat of the support;

an enclosure positioned above the support and the gearbox, the enclosure including:

a cylindrical body coupled to the support, the cylindrical body forming an internal cavity;

a cover positioned above the cylindrical body, the cover including:

a concave surface with respect to the internal cavity of the cylindrical body;

a material inlet channel formed through the cover; and a particle outlet channel formed through the cover, and adjacent to the material inlet channel;

a base component positioned within the internal cavity of the cylindrical body opposite the cover, the base component including:

an aperture formed through the base component, and a concave surface with respect to the internal cavity of the cylindrical body, the concave surface extending over the entirety of the base component from a first end of the base component coupled directly to an inner surface of the cylindrical body to a second end of the base component defining the aperture formed through the base component;

a curved journal opening formed through the cylindrical body between the cover and the base component; and a journal opening cover coupled to the cylindrical body and covering the curved journal opening;

a rotatable table positioned within the internal cavity formed by the cylindrical body, the rotatable table coupled to the gearbox and extending through the aperture of the base component;

a journal positioned above and adjacent the rotatable table;

a trunnion coupled to the journal, the trunnion positioned adjacent the journal opening cover of the enclosure; and a particle screening device positioned adjacent the cover, at least a portion of the particle screening device positioned within the internal cavity formed by the cylindrical body of the enclosure.

12. The vertical pulverizer system of claim 11, further comprising a material feed pipe coupled to the material inlet channel formed in the cover, the material feed pipe extending at least partially through the particle screening device.

13. The vertical pulverizer system of claim 11, wherein the enclosure further comprises a gas inlet opening formed through the cylindrical body, the gas inlet opening positioned between the base component and the journal.

14. The vertical pulverizer system of claim 11, wherein the enclosure further comprises a frustoconical component positioned between and coupled to the cylindrical body and the cover.

15. The vertical pulverizer system of claim 11, wherein at least a portion of the trunnion is positioned within the internal cavity of the cylindrical body of the enclosure.

16. The vertical pulverizer system of claim 11, further comprising a top seal surrounding the particle screening device, the top seal positioned between a portion of the cover of the enclosure and the particle screening device.

17. The vertical pulverizer system of 11, further comprising a scraper coupled to the rotatable table, the scraper positioned adjacent the concave surface of the base component.

* * * * *